United States Patent [19]

Harper

[11] Patent Number: 4,590,674

[45] Date of Patent: May 27, 1986

[54] SHAVING IMPLEMENT HAVING ADJUSTABLE ANNULAR BLADES

[76] Inventor: Frederick R. Harper, P.O. Box 6615, Jeddah 21452, Saudi Arabia

[21] Appl. No.: 683,461

[22] Filed: Dec. 19, 1984

[51] Int. Cl.[4] ..... B26B 21/22; B26B 21/28

[52] U.S. Cl. ..... 30/49; 30/50

[58] Field of Search ..... 30/49, 50, 32

[56] References Cited

U.S. PATENT DOCUMENTS

| | | | |
|---|---|---|---|
| 1,501,450 | 7/1924 | Hasselquist | 30/49 X |
| 1,958,718 | 5/1934 | Schermack | 30/49 |
| 2,632,242 | 3/1953 | Musso | 30/49 X |
| 3,052,023 | 9/1962 | Meohas | 30/32 X |
| 3,127,676 | 4/1964 | Johnson | 30/49 |

FOREIGN PATENT DOCUMENTS

| | | | |
|---|---|---|---|
| 180805 | 12/1917 | Canada | 30/49 |
| 417614 | 9/1910 | France | 30/49 |
| 286594 | 12/1952 | Switzerland | 30/49 |
| 15373 | of 1908 | United Kingdom | 30/49 |
| 111894 | 12/1917 | United Kingdom | 30/49 |
| 330869 | 6/1930 | United Kingdom | 30/49 |

*Primary Examiner*—Jimmy C. Peters

*Attorney, Agent, or Firm*—Thomas J. Dodd

[57] ABSTRACT

A disposable razor which includes one or more annular blades positioned between a pair of rotatable plates in which the position of the blades can be adjusted by the razor user.

6 Claims, 5 Drawing Figures

SHAVING IMPLEMENT HAVING ADJUSTABLE ANNULAR BLADES

SUMMARY OF THE INVENTION

This invention relates to a shaving implement and will have application to a safety type shaving implement having adjustable annular blades.

Heretofore, safety shaving implements or razors have included one or more blades inclined at substantially right angles to the whiskers. As the blade is drawn over the whiskers a "hacking" effect causes the whiskers to be chopped off at skin level usually with much discomfort.

Razors have also been constructed in which the blades were aligned at an acute angle with respect to the whiskers, producing more of a "slicing" effect and reducing some of the discomfort. Such razors are seen in U.S. Pat. Nos. 2,073,714; 2,094,827; 2,026,229; and 4,128,937. A razor having annular shaped blades would also produce a slicing effect and is more efficient than a razor having a straight blade. A description of such a razor is found in U.S. Pat. Nos. 2,359,584 and 837,718.

The razor of this invention includes one or more annular blades positioned between a pair of plates. The blades are rotatable around an axis to continually provide a sharp blade edge for the razor user.

Accordingly, it is an object of this invention to provide for a novel shaving implement or razor having annular blades.

Another object of this invention is to provide for a shaving implement having annular blades which are adjustable.

Another object of this invention is to provide for a shaving implement which efficiently slices the whiskers from the face with minimum discomfort.

Still another object of this invention is to provide for a disposable shaving implement which is durable and economical.

Other objects of this invention will become apparent upon a reading of the following description.

BRIEF DESCRIPTION OF THE DRAWINGS

A preferred embodiment of the invention has been chosen for purposes of illustration wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art to utilize the invention.

Figure 1:
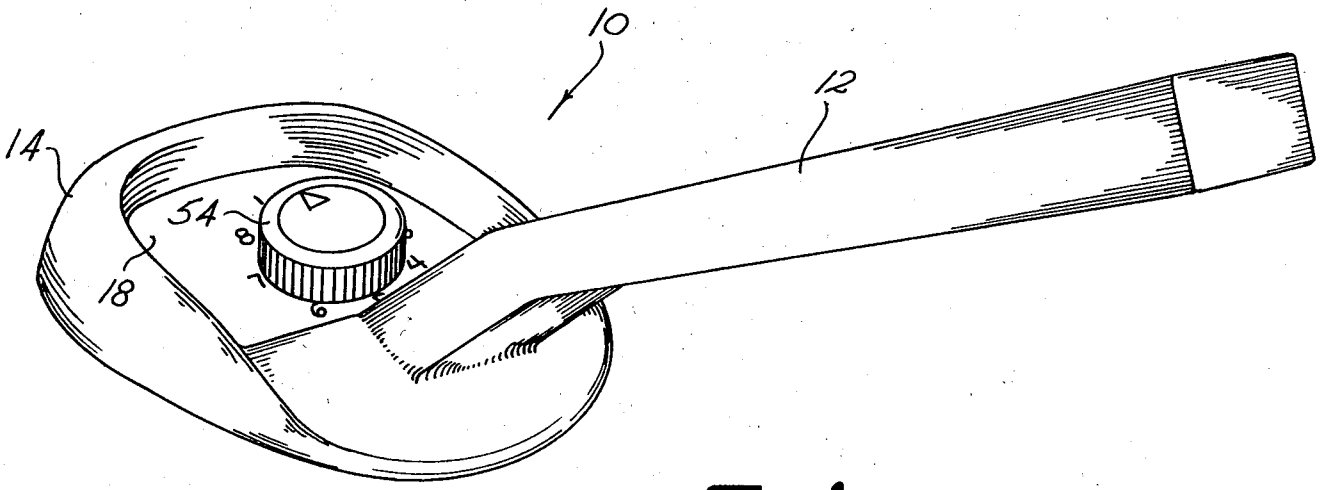
FIG. 1 is a back perspective view of the circular blade razor.
Figure 5:
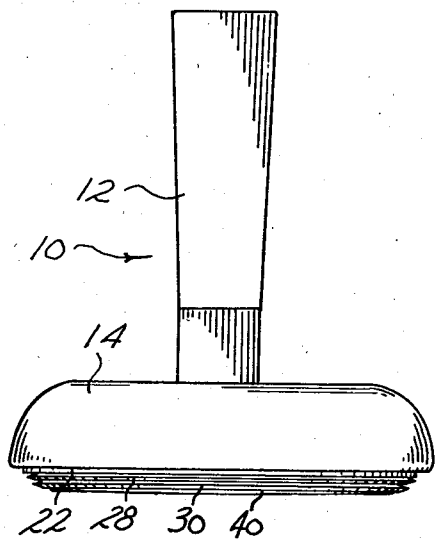
FIG. 5 is a front end view of the razor.
Figure 2:
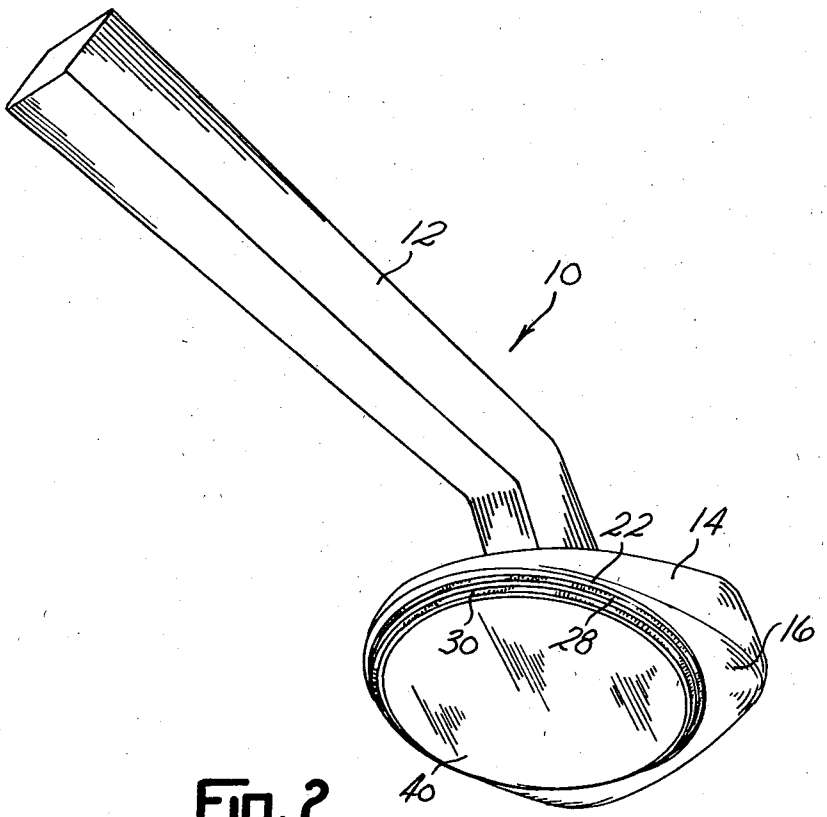
FIG. 2 is a front perspective view of the razor.
Figure 3:
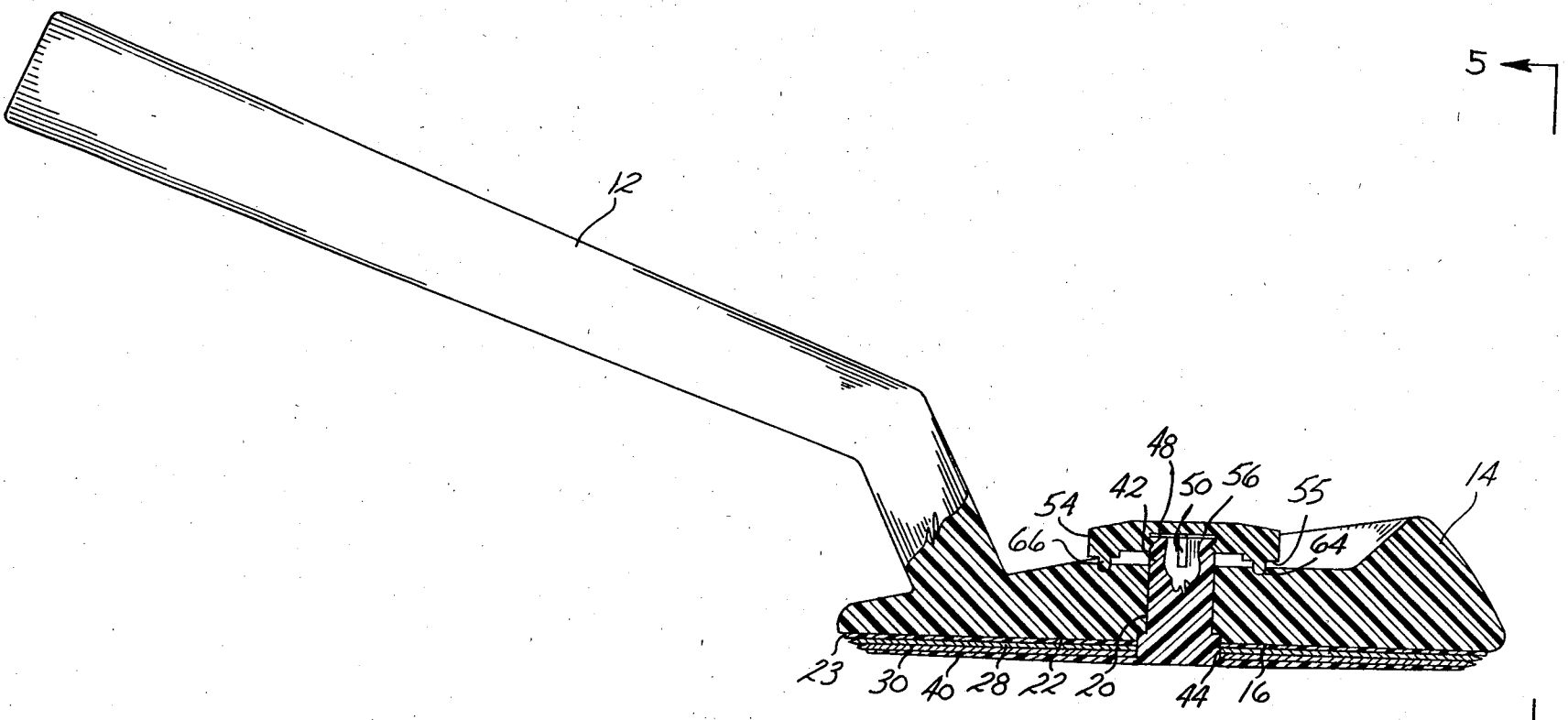
FIG. 3 is a side elevational view of the razor with portions shown in section for purposes of illustration.
Figure 4:
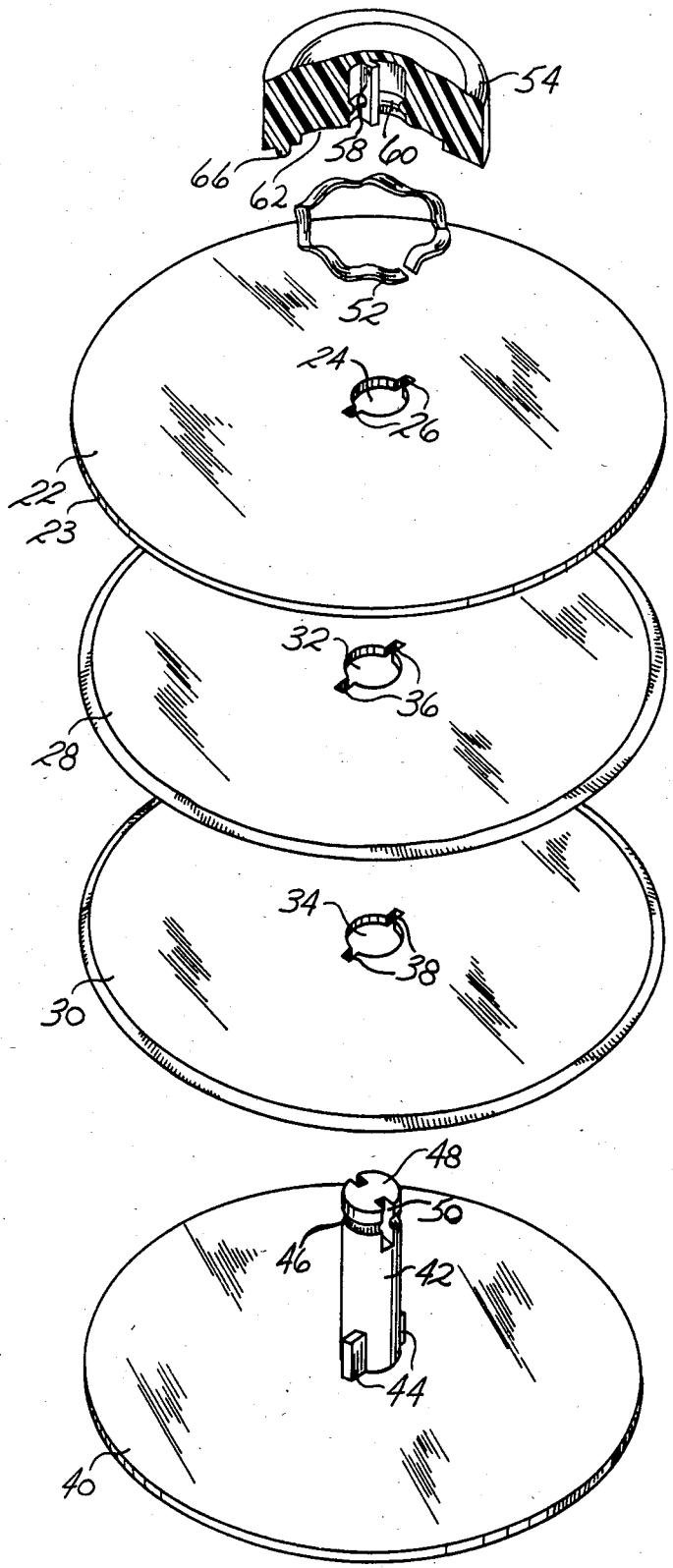
FIG. 4 is an exploded view of the plates and blades showing the razor adjustment mechanism.

The safety razor 10 of this invention has a one-piece body having a handle 12 and a head 14 as shown in FIGS. 1–3. Head 14 has a concave front face 16 and a recessed back face 18. A bore 20 extends through head 14 from the front face 16 to the back face 18.

An annular plate member 22 is positioned adjacent head front face 16 and has a central keyhole 24 including key slots 26. A pair of flat annular blades 28 and 30 are positioned over plate member 22. Blade 28 is of slightly smaller diameter than plate member 22 so that the blade is slightly inset from plate member outer edge 23. Blade 30 is slightly smaller in diameter than blade 28. Each blade 28,30 has a central keyhole 32,34 having key slots 36,38. A plate member 40 is positioned over blade 30 and includes an integral shaft 42 which is fitted through keyholes 24,32,34 and body head bore 20. Shaft 42 includes keys 44 which re fitted into slots 26,36 and 38 of the respective keyholes of plate member 22 and blades 28 and 30. A circumferential groove 46 is formed in shaft 42 of plate member 40 near its outer end 48. A longitudinal slot 50 extends from shaft outer end 48 and terminates at groove 46.

A biasing member, such as spring 52, circumscribes shaft 42 of plate member 40 and contacts head back face 18. An adjustment wheel 54 having an internal bore 56 is fitted over shaft outer end 48. Positioned within wheel bore 56 is both a spline 58 which is fitted into shaft slot 50 and a circumferential rib 60 which snap fits snugly within shaft groove 46 as the wheel 54 is fitted over shaft 42 of plate member 40. Wheel 54 includes a recess 62 at its bottom 55 to accomodate spring 52. When wheel rib 60 snaps into shaft groove 46, plates 22 and 40 and blades 28 and 30 are securely held together under the tension produced by spring 52. Rotation of wheel 54 causes blades 28,30 to rotate about the axis of plate member shaft 42.

To allow controlled rotation of blades 28,30, head back face 18 includes a series of preferably equally radially and angularly spaced indentations 64. Wheel 54 includes a pair of peripheral nibs 66 oppositely positioned on wheel bottom 55 which project into selected indentations 64 to secure the wheel in place with blades 28,30 located at a selected orientation relative to head 14. By turning the wheel 54 when a certain section of blades 28,30 becomes dull or pitted the user is always insured of a close, confortable shave. As shown in FIG. 1, eight adjustments are possible, represented by eight indentations 64 in head 14 to allow for the rotation of the blades 45° to provide a clean sharp shaving surface. Due to the self-honing aspect of the annular blades, the user will often be able to use the razor through two or more complete wheel revolutions. Alternatively, when eight adjustments have been made, the razor may be thrown away.

It is to be understood that the above description does not limit the invention to the precise form disclosed which may be modified within the scope of the appended claims.

I claim:

1. A shaving implement comprising a handle terminating in a head, a planar face-contacting plate member rotatably secured to said head, a first annular blade positioned between said head and said planar face-contacting plate member, and means connecting said blade to said planar face-contacting plate member wherein the blade is rotatable in conjunction with the plate member.

2. The shaving implement of claim 1 and a second annular blade positioned between said first mentioned blade and said head.

3. The shaving implement of claim 2 and a second plate member positioned between said second blade and said head, and means for connecting said planar face-contacting plate member to said second plate member.

4. The shaving implement of claim 3 wherein said blades and plate member include a central keyhole, said head including a bore therethrough aligned with each said keyhole, said plate member including a shaft extending through each said keyhole and said head bore, and a securement means fixed to an end of said shaft for securing said plates and blades to said head.

5. The shaving implement of claim 4 wherein each said keyhole includes a slot extending outwardly of the keyhole, said shaft including a key adapted for extension through each said slot, said securement means fixedly connected to said shaft end and allowing rotation thereof wherein said blades and plates are rotated about said shaft.

6. The shaving implement of claim 4 and biasing means positioned between said securement means and said head for tightly securing said plates and blades to the head during shaving.

* * * * *